US008204407B2

(12) United States Patent
Zona et al.

(10) Patent No.: US 8,204,407 B2
(45) Date of Patent: Jun. 19, 2012

(54) HIGH STRENGTH, LIGHT WEIGHT CORONA WIRES USING CARBON NANOTUBE YARNS, A METHOD OF CHARGING A PHOTORECEPTOR AND A CHARGING DEVICE USING NANOTUBE YARNS

(75) Inventors: Michael F. Zona, Holley, NY (US); Kock-yee Law, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 1079 days.

(21) Appl. No.: 12/062,169

(22) Filed: Apr. 3, 2008

(65) Prior Publication Data

US 2009/0252535 A1 Oct. 8, 2009

(51) Int. Cl.
*G03G 15/02* (2006.01)
*G03G 21/00* (2006.01)

(52) U.S. Cl. ..... 399/171; 250/324; 361/225; 399/170

(58) Field of Classification Search ..... 399/168, 399/170, 171; 250/324, 325, 326; 361/225, 361/229, 230

See application file for complete search history.

(56) References Cited

U.S. PATENT DOCUMENTS

| | | | | |
|---|---|---|---|---|
| 6,205,309 | B1 * | 3/2001 | Gundlach et al. | 399/170 |
| 7,228,091 | B2 * | 6/2007 | Hays et al. | 399/168 |
| 7,397,032 | B2 * | 7/2008 | Zona et al. | 250/326 |
| 7,504,628 | B2 * | 3/2009 | Chen | 250/324 |
| 2004/0081485 | A1 * | 4/2004 | Song et al. | 399/171 |
| 2005/0170089 | A1 | 8/2005 | Lashmore et al. | |
| 2007/0036709 | A1 | 2/2007 | Lashmore et al. | |
| 2008/0014431 | A1 | 1/2008 | Lashmore et al. | |

FOREIGN PATENT DOCUMENTS

| | | | |
|---|---|---|---|
| JP | 2001250467 | A * | 9/2001 |
| JP | 2001272840 | A * | 10/2001 |
| JP | 2002268328 | A * | 9/2002 |
| JP | 2002279885 | A * | 9/2002 |
| JP | 2005316395 | | 11/2005 |
| JP | 2007034196 | A * | 2/2007 |
| JP | 2007279723 | | 10/2007 |

* cited by examiner

*Primary Examiner* — David Gray
*Assistant Examiner* — Fred L Braun
(74) *Attorney, Agent, or Firm* — MH2 Technology Law Group LLP

(57) ABSTRACT

Exemplary embodiments provide methods, materials and devices for a corona charging. Specifically, carbon nanotube yarns can be used as corona wires (or coronode) in a corotron-type or scorotron-type charging device. The carbon nanotube yarns can provide small diameters, and desired electrical, mechanical and thermal properties. The carbon nanotube yarns can have a diameter of about 100 microns or less for a low operating voltage of the charging device.

20 Claims, 3 Drawing Sheets

HIGH STRENGTH, LIGHT WEIGHT CORONA WIRES USING CARBON NANOTUBE YARNS, A METHOD OF CHARGING A PHOTORECEPTOR AND A CHARGING DEVICE USING NANOTUBE YARNS

DESCRIPTION OF THE INVENTION

1. Field of the Invention

This invention relates generally to charging devices and, more particularly, to charging devices having corona wires using carbon nanotube yarns.

2. Background of the Invention

In the electrophotographic process, various charging devices are needed to charge a photoreceptor, recharge a toner layer, charge an intermediate transfer belt for electrostatic transfer of toner, or charge a sheet of media, such as a sheet of paper. Corotron-type devices are often used for a corona charging process, which may use corona wires, such as metals or metal alloys, strung into the corotron-type devices. For example, a tungsten or tungsten alloy can be used as a corona wire due to its high strength and excellent thermal stability.

Typically, the diameter of the corona wires is an important feature for corotron-type devices. For example, during negative corona generation, the amount of negative ions generated in a corotron device is largely driven by the diameter of the corona wire. As the wire diameter is reduced, the required voltage to provide corona onset can be reduced. Problems arise, however, because conventional materials used for corona wires have a diameter limitation. For example, metal wires begin to stretch over time and become very difficult to string into a corotron-type device when the wire diameter is about 30 microns or less.

Thus, there is a need to overcome these and other problems of the prior art and to provide materials, and devices having small diameter corona wires to facilitate the corona charging.

SUMMARY OF THE INVENTION

According to various embodiments, the present teachings include a charging device. The charging device can include a receptor and a coronode that is disposed opposing and spaced apart from the receptor. The coronode can further include one or more carbon nanotube yarns arranged to emit a corona charge to the receptor. Each carbon nanotube yarn can have a minor dimension of about 100 microns or less in order to provide a low operating voltage of the charging device.

According to various embodiments, the present teachings also include a method for charging a receptor. The receptor can be spaced apart from a coronode that includes carbon nanotube yarns arranged to emit a corona charge. Each carbon nanotube yarn can have a minor dimension of about 100 microns or less. During charging, a low operating voltage of about 5 kV or less can be applied to the coronode to generate charged species that are deposited on the receptor.

According to various embodiments, the present teachings further include a charging device. The charging device can include a receptor and a coronode that is disposed opposing and spaced apart from the receptor. Carbon nanotube yarns can be arranged as the coronode to emit a corona charge to the receptor using a low operating voltage of about 5 kV or less, and each carbon nanotube yarn can include a width or diameter of about 100 microns or less.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

DESCRIPTION OF THE EMBODIMENTS

Figure 1:
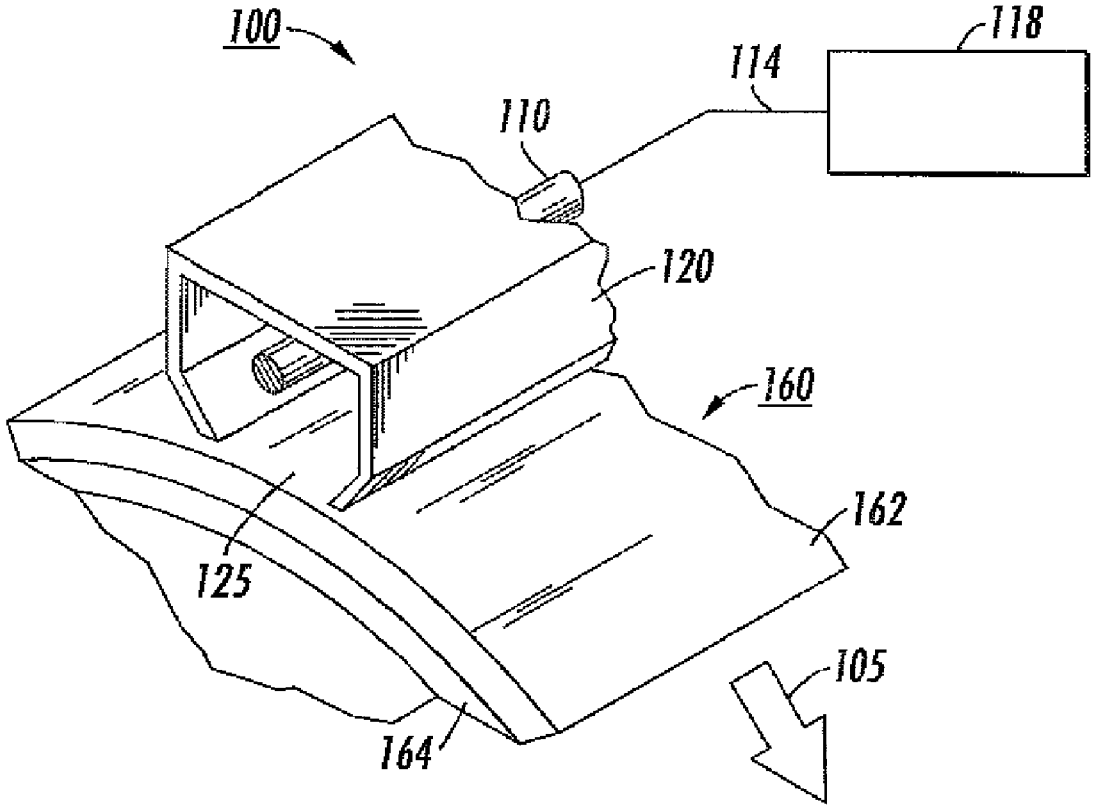
FIG. 1 depicts an exemplary corotron-type charging device in accordance with the present teachings.

Reference will now be made in detail to the present embodiments (exemplary embodiments) of the invention, examples of which are illustrated in the accompanying drawings. Wherever possible, the same reference numbers will be used throughout the drawings to refer to the same or like parts. In the following description, reference is made to the accompanying drawings that form a part thereof, and in which is shown by way of illustration specific exemplary embodiments in which the invention may be practiced. These embodiments are described in sufficient detail to enable those skilled in the art to practice the invention and it is to be understood that other embodiments may be utilized and that changes may be made without departing from the scope of the invention. The following description is, therefore, merely exemplary.

While the invention has been illustrated with respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." As used herein, the term "one or more of" with respect to a listing of items such as, for example, A and B, means A alone, B alone, or A and B. The term "at least one of" is used to mean one or more of the listed items can be selected.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g., −1, −2, −3, −10, −20, −30, etc.

Exemplary embodiments provide materials, devices and methods for corona charging. Specifically, carbon nanotube yarns can be used as corona wires (or coronode) in a corotron-type or scorotron-type charging device. The carbon nanotube yarns can provide small diameters, as well as desired electrical, mechanical and thermal properties. The carbon nanotube yarns can have a diameter of about 100 microns or less for a low operating voltage of the charging device.

As used herein and unless otherwise specified, the term "nanotube yarns" refers to any elongated materials that have at least one minor dimension, for example, width or diameter, about 100 microns or less. In an additional example, the "nanotube yarns" can have at least one minor dimension of about 50 microns or less. In a further example, the "nanotube yarns" can have at least one minor dimension of about 10 microns to about 50 microns. The elongated "nanotube yarns" can have a sufficient length to be configured as (e.g., strung into) a coronode for a charging device. For example, the sufficient length can be in a range of about 30 cm to about 1 m. In various embodiments, the "nanotube yarn" can have dimensional uniformity across the length of the nanotube yarn and provide a charging uniformity upon biasing for the disclosed charging device.

Note that although the term "nanotube yarn" is referred to throughout the description herein for illustrative purposes, it is intended that the term also encompass other elongated materials of like dimensions, for example, made from nanoshafts, nanopillars, narfowires, nanorods, or nanoneedles and in a form including, but not limited to, a fiber, filament, thread, fabric, ribbon, horn, or spiral.

In various embodiments, the nanotube yarns can have various cross sectional shapes, regular or irregular, such as, for example, rectangular, polygonal, oval, elliptical, square, tapered or circular shapes. The nanotube yarns can be formed of conductive or semi-conductive materials. For example, the nanotube yarn can be a carbon nanotube yarn including single-walled carbon nanotube (SWCNT), double-walled carbon nanotube, and/or multi-walled carbon nanotube (MWCNT). In various embodiments, the carbon nanotube yarn can include modified nanotubes from all possible nanotubes thereabove and their combinations. The modification of the nanotubes can include a physical and/or a chemical modification.

The nanotube yarns can be assembled from individual strands of, for example, carbon nanotubes. The nanotubes can be fabricated by a number of methods including, but not limited to, arc discharge, pulsed laser vaporization, chemical vapor deposition (CVD), high pressure carbon monoxide processing, or any other suitable techniques known in the related art. The nanotubes can be less than about 50 nanometers in diameter and can be up to centimeters in length. For example, the nanotubes can have a diameter of about 0.5 nm to about 20 nm and can have a length of about 200 nm to about 1 cm. By controlling various parameters, such as composition, shape, length, etc., the electrical, mechanical, and thermal properties of the nanotubes can be controlled. For example, the nanotubes can be formed to be conducting or semiconducting depending on, for example, the chirality of the nanotubes. Moreover, the nanotubes can in general have yield stresses greater than that of steel. Additionally, the nanotubes can in general have thermal conductivities greater than that of copper, and in some cases, comparable to, or greater than that of diamond.

The nanotube yarns can be formed by an assembly from individual strands of nanotubes. For example, the nanotube yarns can be formed by first forming nanotubes from a CVD process followed by spinning the formed carbon nanotubes into nanotube yarns. In various embodiments, following the spinning process, the nanotube yarns can undergo a post-synthesis treatment to align (e.g., to stretch) the carbon nanotubes in a subsequently parallel orientation. The post-synthesis treatment can increase mechanical property and/or electrical conductivity.

In various embodiments, the formation of nanotube yarns can be found as described in the related U.S. patent application Ser. No. 11/035,471, entitled "Systems and Methods for Synthesis of Extended Length Nanostructures," U.S. patent application Ser. No. 11/488,387, entitled "Systems and Methods for Formation and Harvesting of Nanofibrous Materials," and U.S. patent application Ser. No. 11/488,387, entitled "Systems and Methods of Synthesis of Extended Length Nanostructures," which are hereby incorporated by reference in their entirety.

In various embodiments, the nanotube yarn can have a single yarn (i.e., a ply) from a first spinning process, or can have 2-ply, 3-ply, 4-ply or more-ply yarns formed by plying single yarns together, e.g., using a twist that is opposite to the one used in the initial spinning of the strands. For example, a plied yarn can be made up of single strands that have been spun with an S twist. Such plying can make the yarns stronger and more uniform.

The disclosed nanotube yarns can be formed as a coronode to provide desired electrical, mechanical and thermal properties for the application of, such as a wire corotron or scorotron. For example, the carbon nanotube yarns can provide a mechanical tensile strength of about 800 MPa or higher. In an additional example, the carbon nanotube yarns can provide a mechanical tensile strength ranging from about 1 GPa to about 6 GPa. The carbon nanotube yarns can also have an electrical resistivity of about $1\times10^{-4}$ Ω-cm, for example, and a density of about 0.3 gm/cc or less.

Table 1 provides related properties for an exemplary carbon nanotube (CNT) yarn and compares the exemplary CNT yarn with various known materials in accordance with the present teachings.

As shown, the disclosed CNT yarns can provide a high mechanical tensile strength as compared with various known materials such as Aramids, aluminum, stainless steel, and AF 1410, and a low density as compared with various materials of nanotubes, aluminum, steel, copper and graphite. In addition, the disclosed CNT yarns can provide a low resistivity of about $4\times10^{-4}$ ohm-cm or less, and a good thermal conductivity of about 70 W/m$^{0}$K. Such thermal conductivity can be effectively 6 times superior to metal copper by weight.

TABLE 1

| Property | CNT Yarn | Other materials |
|---|---|---|
| Tensile strength | 1-6 GPa (≧800 Mpa) | Aramids: ~3 GPa<br>Aluminum: ~500 MPa<br>Stainless Steel: ~700 MPa<br>AF 1410: ~1700 MPa |
| Density (gm/cc) | 0.2-0.3 | Nanotubes: 1.3<br>Aluminum: 2.8<br>Steel: 7.8<br>Copper: 8.2<br>Graphite: 2.2 |

TABLE 1-continued

| Property | CNT Yarn | Other materials |
|---|---|---|
| Resistivity (ohm-cm) | $4 \times 10^{-4}$ or less | |
| Thermal conductivity (Watts/m°K) | 70 | |

Figure 2A:
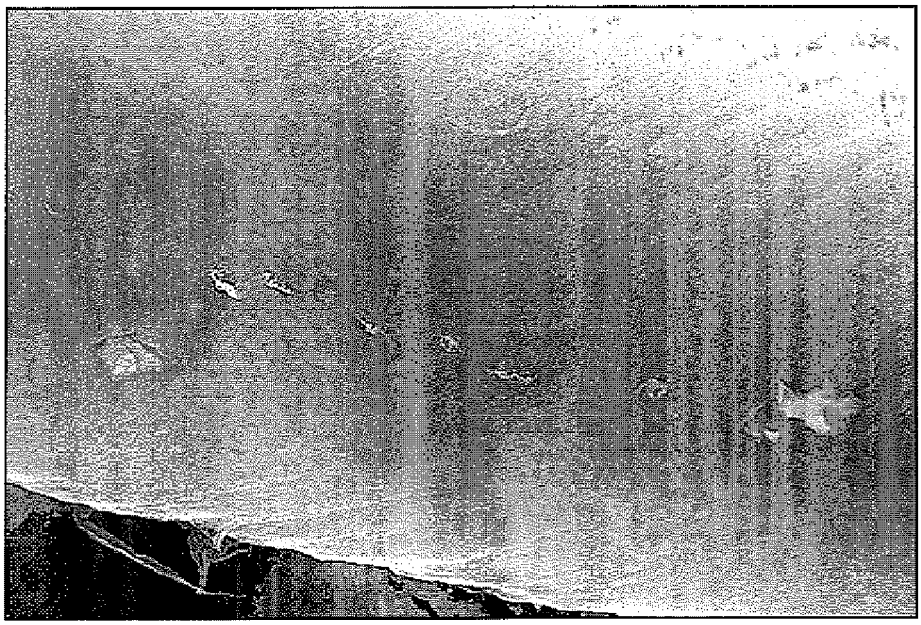
FIGS. 2A-2B depict various exemplary carbon nanotube (CNT) yarns used for the coronode in accordance with the present teachings.
Figure 2B:
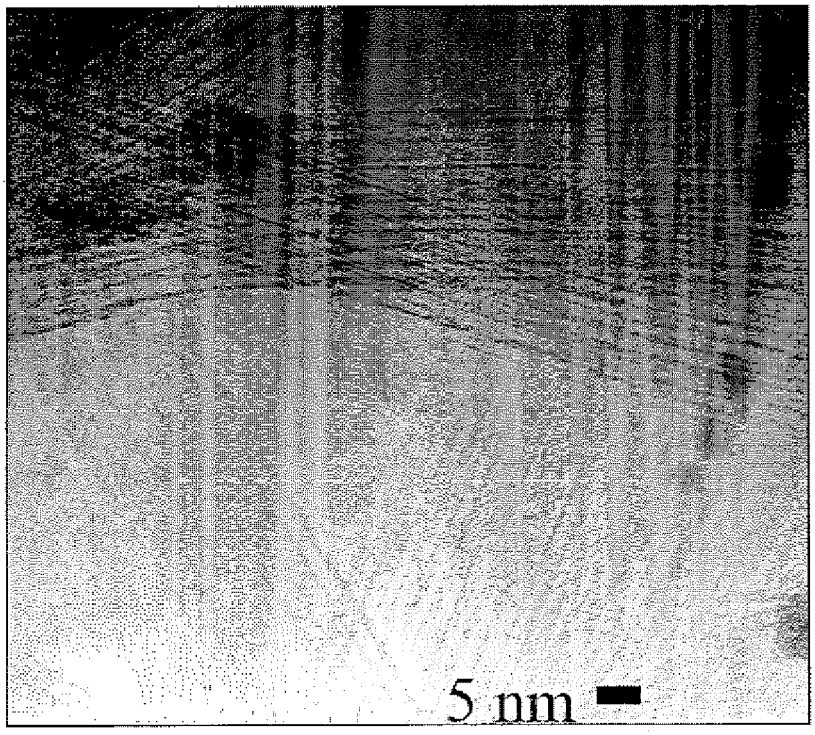
Figure 3:
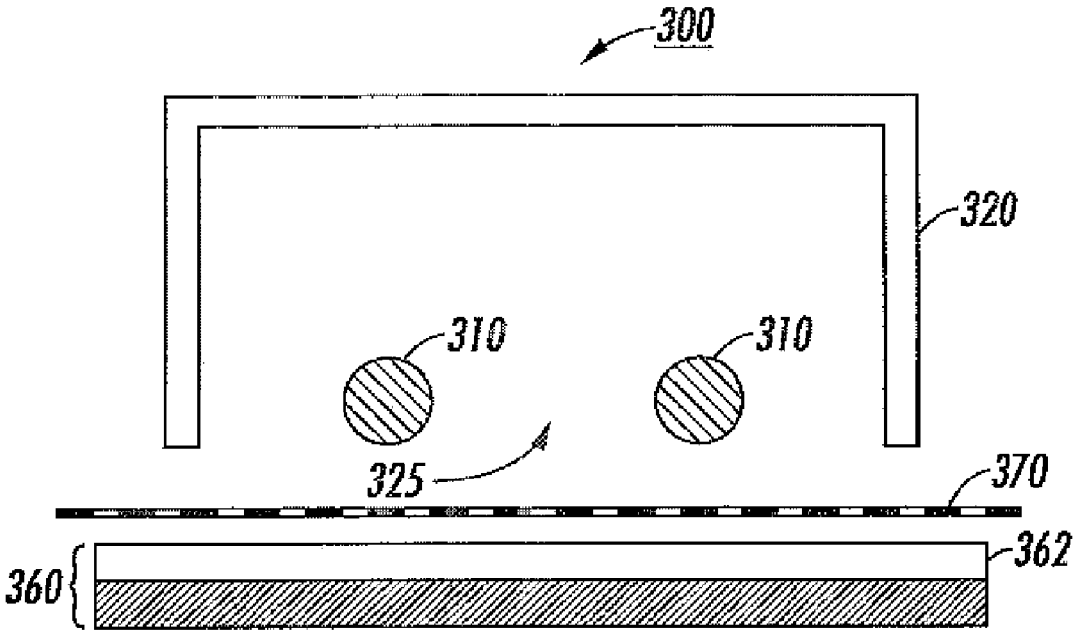
FIG. 3 depicts an exemplary scorotron-type charging device in accordance with the present teachings.

FIGS. 1-3 depict exemplary embodiments for the disclosed nanotube yarns used in corontron-type or scorontron-type charging devices in accordance with the present teachings. For example, FIG. 1 depicts an exemplary corotron-type charging device 100 in accordance with the present teachings. It should be readily apparent to one of ordinary skill in the art that the device 100 depicted in FIG. 1 represents a generalized schematic illustration and that other yarns/coronodes/elements can be added or existing yarns/coronodes/elements can be removed or modified.

As shown, the charging device 100 can include a coronode 110 and a conductive shield 120, partially surrounding the coronode 110 such that an opening 125 or slit of conductive shield 120 faces a receptor 160. Receptor 160 can include a photoconductive surface 162, which can be disposed opposing and apart from the coronode 110.

The coronode 110 can include a charging generator yarn/wire for depositing an electrostatic charge on the surface of the moving receptor 160. The coronode 110 can be, for example, a single wire coronode or an array of wire coronodes formed of the disclosed carbon nanotube yarns. In various embodiments, coronode 110 can be a circular shaped yarn coronode having a diameter of about 100 microns or less. In an additional example, the yarn coronode can have a diameter of about 30 microns or less. In some cases, the yarn coronode can have a diameter of about 10 microns. Alternatively, the coronode can have any cross sectional shape including oval, tear-drop shaped, multi-lobal including trilobal, and the like.

FIGS. 2A-2B illustrate various exemplary CNT yarns used as coronode (e.g., 110) in accordance with the present teachings. Specifically, FIG. 2A depicts an exemplary yarn surface; and FIG. 2B depicts exemplary CNT yarns made from SWCNTs. As shown, the CNT yarns shown in FIGS. 2A-2B can be used for the coronode 110 of the exemplary charging device 100, where the CNT can be formed from carbon nanotubes having an exemplary diameter of about 3 nm.

Referring back to FIG. 1, the corona generating unit, including the conductive shield 120 enclosing one or more coronodes 110, can be positioned above the receptor surface 162 and arranged to deposit an electrical charge thereon as the receptor surface 162 moves in the indicated direction 105. The opening 125 formed in the bottom of the shield 120 can be opposite the moving photoconductive surface 162 and provides a path by which a flow of charged species can be directed towards and deposited upon the moving receptor surface 162.

In various embodiments, the receptor 160 can include a drum having a diameter of about 120 mm or less. One of ordinary skill in the art will understand that exemplary receptors can also include a toner layer, a sheet of media on which toner can be deposited, or a transfer belt. In an exemplary embodiment, the receptor 160 can be a photoreceptor. As shown in FIG. 1, the receptor 160 can further include a conductive substrate 164, with the photoconductive surface 162 placed thereupon such that the receptor 160 can be arranged to move along a predetermined path of travel in the indicated direction 105.

In operation, the corona generating yarn/wire (i.e., the coronode 110) can be connected by suitable means such as an electrical connector 114 to a high potential source 118, for example, a first power supply. For example, the shield 120 can be grounded and a DC voltage can be applied to the coronode 110 by the first power source 118. The DC voltage can generate charged species, such as, for example, electrons and/or gaseous ions, to charge or discharge the photoconductor surface 162. Specifically, the high electric field at the CNT yarns of the coronode 110 can generate a corona plasma, i.e., create a positive ion, a free electron and/or a negative ion. In addition, the charge species generated by the corona can collide with other gas molecules or atoms, potentially ionizing those molecules/atoms to generate additional charge species that can move to photoconductor surface 162. In various embodiments, the voltage threshold for charge emission can be about 4-5 kV or less, due to a small diameter and exceptional properties of the CNT yarn used for the coronode 110. In various other embodiments, a second voltage can be applied to shield 120 to regulate the flow of charged particles to photoconductive surface 162.

FIG. 3 depicts an exemplary scorotron-type charging device 300 in accordance with the present teachings. It should be readily apparent to one of ordinary skill in the art that the device 300 depicted in FIG. 3 represents a generalized schematic illustration and that other yarns/coronodes/elements can be added or existing yarns/coronodes/elements can be removed or modified.

As shown, the device 300 can include one or more coronodes 310 and a conductive shield 320 partially surrounding the one or more coronodes 310 such that an opening 325 of the conductive shield faces a receptor 360. Receptor 360 can include a photoconductive surface 362 disposed opposing and apart from coronodes 310. In various embodiments, the coronodes 310 (as similar to the coronode 110 in FIG. 1) can be constructed from the disclosed CNT yarns that have an exemplary diameter of about 50 microns or less, in some cases, about 30 microns or less, so as to provide a low operating voltage of the charging device 300.

The scorotron-type charging device 300 can further include a screen 370 disposed between coronodes 310 and photoconductive surface 362 to control charging or discharging. Screen (or "grid") 370 can be formed of a conductive material and can be configured in a fashion known to one of ordinary skill in the art.

In operation, shield 320 can be grounded and a DC voltage can be applied to coronodes 310. The DC voltage, e.g., supplied by a first power supply (not shown), can generate charged species, such as, for example, electrons and/or gaseous ions to charge or discharge photoconductor surface 362. Screen 370 can be biased with an electric potential close to that desired at photoconductor surface 362 using a second power supply (not shown) to prevent the potential at photoconductor surface 362 from rising above the potential of screen 370. As disclosed above, it is believed that, by applying the voltage to yarn/wire coronodes 310, the generated field strength can exceed the threshold electric field for generating charged species, such as electrons and/or gaseous ions that can move to photoconductor surface 362. In various embodiments, the voltage threshold for charge emission can be 4 to 5 kV or less due to the use of small diameter CNT yarns as the wire/yarn coronodes 310. In various embodiments, the threshold electric field can be about 2.0 V/μm or less.

In various embodiments, one or more arrays of pin-type coronodes can also be used in combination of the disclosed coronodes as shown in FIG. 1 and/or FIG. 3.

In various embodiments, the disclosed charging devices and methods (as shown in FIGS. 1-3) can be used in an electrophotographic printing machine such as a xerographic printing machine. For example, the disclosed charging devices and methods can be used in an imaging forming process that involves an electrostatically-formed latent image on a charged receptor (e.g., receptor 160 or 360 in FIG. 1 or 3), for example, using the charging device 100 or 300. The latent image can be developed by bringing charged developer materials, e.g., charged toner particles, into contact with the charged receptor to form the desired image.

It should be appreciated that, while disclosed devices and methods have been described in conjunction with exemplary electrophotographic and/or xerographic image forming systems, devices and methods according to this disclosure are not limited to such applications. Exemplary embodiments of devices and methods according to this disclosure can be advantageously applied to virtually any device to which charge is to be imparted.

Other embodiments of the invention will be apparent to those skilled in the art from consideration of the specification and practice of the invention disclosed herein It is intended that the specification and examples be considered as exemplary only, with a true scope and spirit of the invention being indicated by the following claims.

What is claimed is:

1. A charging device comprising:

a receptor; and a wire coronode disposed opposing and spaced apart from the receptor, wherein the wire coronode comprises one or more carbon nanotube yarns arranged to emit a corona charge to the receptor using a low operating voltage, and each of the one or more carbon nanotube yarns has a minor dimension of about 100 microns or less and a resistivity of about $4\times10^{-4}$ Ω-cm or less.

2. The device of claim 1, wherein each of the one or more carbon nanotube yarns has a width or a diameter of about 50 microns or less.

3. The device of claim 1, wherein each of the one or more carbon nanotube yarns has a diameter ranging from about 10 microns to about 30 microns.

4. The device of claim 1, wherein each of the one or more carbon nanotube yarns has a length of from about 30 cm to about 1 m.

5. The device in claim 1, wherein each of the one or more carbon nanotube yarns has a tensile strength of about 800 MPa or greater.

6. The device of claim 1, wherein each of the one or more carbon nanotube yarns has a tensile strength ranging from about 1 GPa to about 6 GPa.

7. The device of claim 1, wherein each of the one or more carbon nanotube yarns has a density of about 0.3 gm/cc or less.

8. The device of claim 1, wherein the low operation voltage is about 5kV or less.

9. The device of claim 1, further comprising a conductive shield, wherein the conductive shield partially surrounds the wire coronode.

10. The device of claim 1, further comprising:

a screen disposed between the wire coronode and the receptor; and a second power supply that supplies a second voltage to the screen.

11. The charging device of claim 1, wherein the wire coronode comprises a plurality of single nanotube yarns plied together.

12. A charging device comprising:

a receptor; and a wire coronode disposed opposing and spaced apart from the receptor, wherein the wire coronode comprising one or more carbon nanotube yarns being arranged to emit a corona charge to the receptor using a low operating voltage of about 5kV or less, and each of the one or more carbon nanotube yarns comprises a width or diameter of about 50 microns or less and a resistivity of about $4\times10^{-4}$ Ω-cm or less.

13. A method of charging a receptor comprising:

providing a wire coronode comprising one or more carbon nanotube yarns arranged to emit a corona charge, wherein each of the one or more carbon nanotube yarns has a minor dimension of about 100 microns or less and a resistivity of about $4\times10^{-4}$ Ω-cm or less;

providing a receptor spaced apart from the wire coronode; and applying an operating voltage of about 5kV or less to the wire coronode to generate one or more charged species that are deposited on the receptor.

14. The method of claim 13, further comprising applying a second voltage to a shield disposed spaced apart from and partially surrounding the wire coronode to regulate a flow of the one or more charged species to the receptor.

15. The method of claim 13, further comprising:

providing a screen between the wire coronode and the receptor; and applying a second voltage to the screen, wherein the second voltage is at or near a receptor voltage.

16. The method of claim 13, further comprising forming the one or more carbon nanotube yarns comprising:

forming a plurality of carbon nanotubes by a chemical vapor deposition (CVD) process, and spinning the formed plurality of carbon nanotubes into the one or more yarns.

17. The method of claim 16, further comprising a post-synthesis treatment to align the spun plurality of carbon nanotubes in a substantially parallel orientation.

18. The method of claim 16, wherein the plurality of carbon nanotubes are selected from the group consisting of single-walled carbon nanotubes, double-walled carbon nanotubes, multi-walled carbon nanotubes and mixtures thereof.

19. The method of claim 16, wherein each of the plurality of carbon nanotubes has a diameter ranging from about 0.5 nm to about 20 nm.

20. The method of claim 16, wherein each of the plurality of carbon nanotubes has a length ranging from about 200 nm to about 1 cm.

* * * * *